United States Patent [19]

Smith

[11] 4,190,193

[45] Feb. 26, 1980

[54] SELF-CONTAINED CLAMP-MOUNTED PIVOTAL ARM MAILBOX SIGNAL DEVICE ASSEMBLY

[76] Inventor: George T. Smith, 7401 N. Williams Rd., Lansing, Mich. 48910

[21] Appl. No.: 946,135

[22] Filed: Sep. 27, 1978

[51] Int. Cl.[2] ..... A47G 29/12

[52] U.S. Cl. ..... 232/35

[58] Field of Search ..... 232/35, 34

[56] References Cited

U.S. PATENT DOCUMENTS

| | | | |
|---|---|---|---|
| 1,627,617 | 5/1927 | Nordin | 232/35 |
| 2,859,913 | 11/1958 | Paschke et al. | 232/35 |
| 2,988,268 | 6/1961 | Mioduski | 232/35 |
| 3,084,853 | 4/1963 | Kopp | 232/35 |
| 3,747,839 | 7/1973 | Morton | 232/35 |

*Primary Examiner*—Francis K. Zugel

*Attorney, Agent, or Firm*—Miller, Morriss and Pappas

[57] ABSTRACT

A self-contained mailbox signal device assembly is provided which is selectively clamp-mountable against the exterior surface of a mailbox and which is provided with a gravity actuated pivotal signal arm. The pivotal signal arm is weighted at one end and is provided with a flag indicator signal portion at the other end thereof. The pivotal signal arm is adapted to be maintained in a substantially horizontal position when the weighted end thereof is supportably engaged by a support arm extension provided in the closed door of the mailbox. When the door of the mailbox is opened, the weighted portion of the signal arm disengages from the support arm extension and moves in a downward arc in response to gravitational pull. This causes the signal arm to pivotally move into its upright signal position with the weighted portion down and the indicator signal portion up so as to indicate to a remote observer that the mailbox has been opened and presumably mail has been deposited therein.

3 Claims, 7 Drawing Figures

SELF-CONTAINED CLAMP-MOUNTED PIVOTAL ARM MAILBOX SIGNAL DEVICE ASSEMBLY

SUMMARY OF THE INVENTION

This invention relates to a self-contained mailbox signal device assembly which is adapted to be selectively clamp-mounted upon the exterior of a mailbox without the need for ancillary connecting or mounting means integral with the mailbox structure. An adjustable flexible band support member is provided for selective clamp-mounted mating engagement with the exterior upper surface of a mailbox by clampably engaging the lower longitudinal bottom edges along each side of the mailbox. A pivotal signal arm is pivotally mounted on said flexible band support member so as to be pivotal in a vertical plane along one side of the mailbox. The signal arm is provided with a weighted portion at one end thereof and a flag indicator signal portion at the other end thereof so that the pivotal signal arm automatically assumes a vertical upright signal position when it is not restricted in any way. A support arm extension is clampably attached to the door of the mailbox proximate to the flexible band support member and to the pivotal signal arm. Thus positioned, the support arm extension is adapted to selectively supportably engage the weighted portion of the pivotal signal arm when the mailbox door is closed so as to maintain the pivotal support arm in a substantially horizontal non-signal position along the side of the mailbox. When the mailbox door is opened, the support arm extension is pulled away from the weighted portion of the pivotal signal arm resting thereon. The weighted portion thus falls in response to gravitational pull and the signal arm automatically pivots to its upright "signal" position with flag indicator portion thereof clearly visible to a remote observer so as to indicate that mail has been delivered to the mailbox. After the mail has been removed from the mailbox, the signal arm is returned to its horizontal "non-signal" position with the weighted portion thereof resting upon the support arm extension of the closed mailbox door and is ready to signal the next mail delivery.

While there are many mailbox signal devices in the prior known art, such devices are integral with the mailboxes with which they are used. Even with the simplest of the prior art devices, it is necessary to drill holes into or otherwise violate the integrity of the mailbox structure itself. Some of such prior art devices utilize complicated linkage mechanisms which are expensive and difficult to fabricate. Representative of the known prior art United States Patents are Mitchell U.S. Pat. No. 400,244, Calvert U.S. Pat. No. 487,210, Peers U.S. Pat. No. 621,973, Robinson U.S. Pat. No. 753,163, Morrow U.S. Pat. No. 812,514, Farrar U.S. Pat. No. 815,585, Farrar U.S. Pat. No. 924,651, Scheerer U.S. Pat. No. 3,675,845, James, Sr. U.S. Pat. No. 3,722,460, File U.S. Pat. No. 3,904,108, Caldwell U.S. Pat. No. 3,968,928 and Malik U.S. Pat. No. 4,005,816.

Nowhere in the prior art is there shown a self-contained mailbox signal device assembly which can be selectively clampably installed upon a mailbox without violating the structural integrity thereof and which does not require complicated linkage mechanisms in operation.

It is therefore an object of this invention to provide a self-contained mailbox signal device assembly which can be selectively clamp-mounted upon an existing mailbox without violating the structural integrity of the mailbox in any way.

Another object of this invention is to provide a self-contained mailbox signal device assembly which is provided with a pivotal signal arm which does not require complicated linkage mechanisms in operation.

Other objects and advantages found in the construction of the invention will be apparent from a consideration of the following specification in connection with the appended claims and the accompanying drawings.

IN THE DRAWINGS

DESCRIPTION

Figure 1:
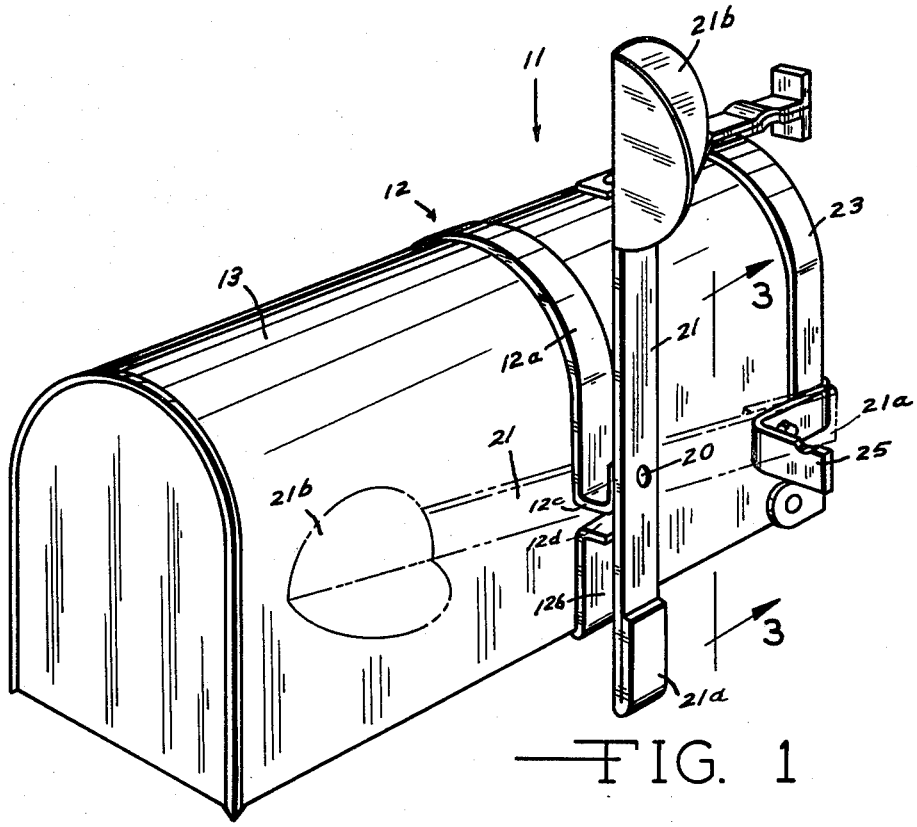
FIG. 1 is a right perspective view of the self-contained mailbox signal device assembly clamp-mounted upon a mailbox with the pivotal signal arm in its upright "signal" position and showing the signal arm in phantom-line in its stored substantial horizontal "non-signal" position.

As shown in the drawings, the self-contained mailbox signal device assembly 11 comprises a flexible band support member 12 which is adapted to be selectively clampable against the upper external surface of a mailbox 13.

Figure 6:
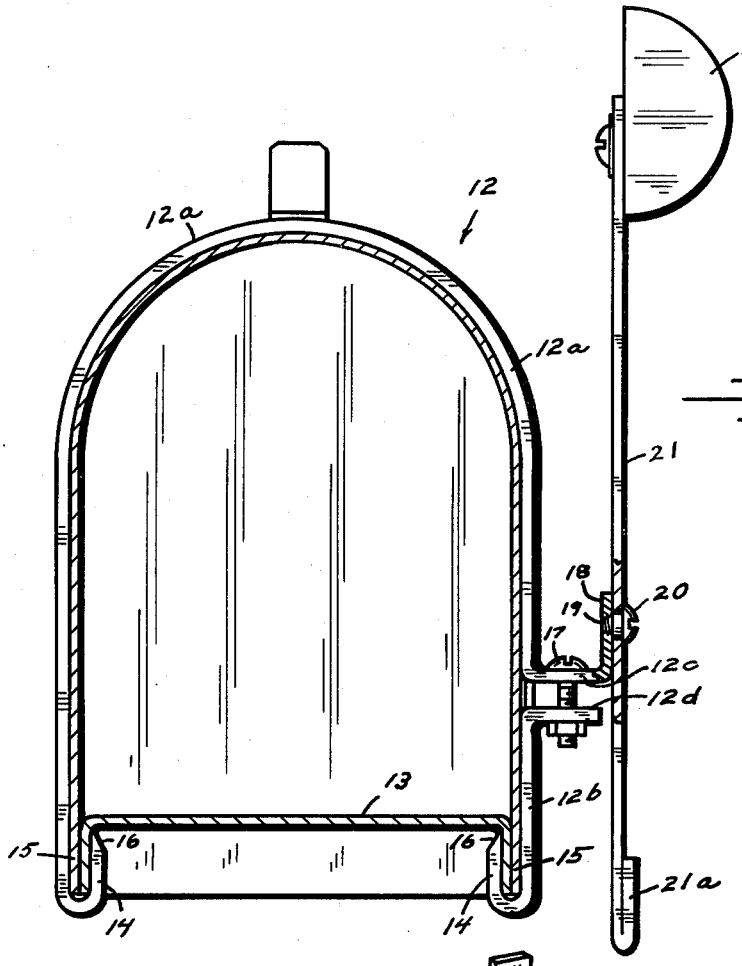
FIG. 6 is a sectional view of the mailbox showing the self-contained mailbox signal device assembly clampably attached to a mailbox and further showing the pivotal signal arm pivoted to its upright "signal" position.
Figure 7:
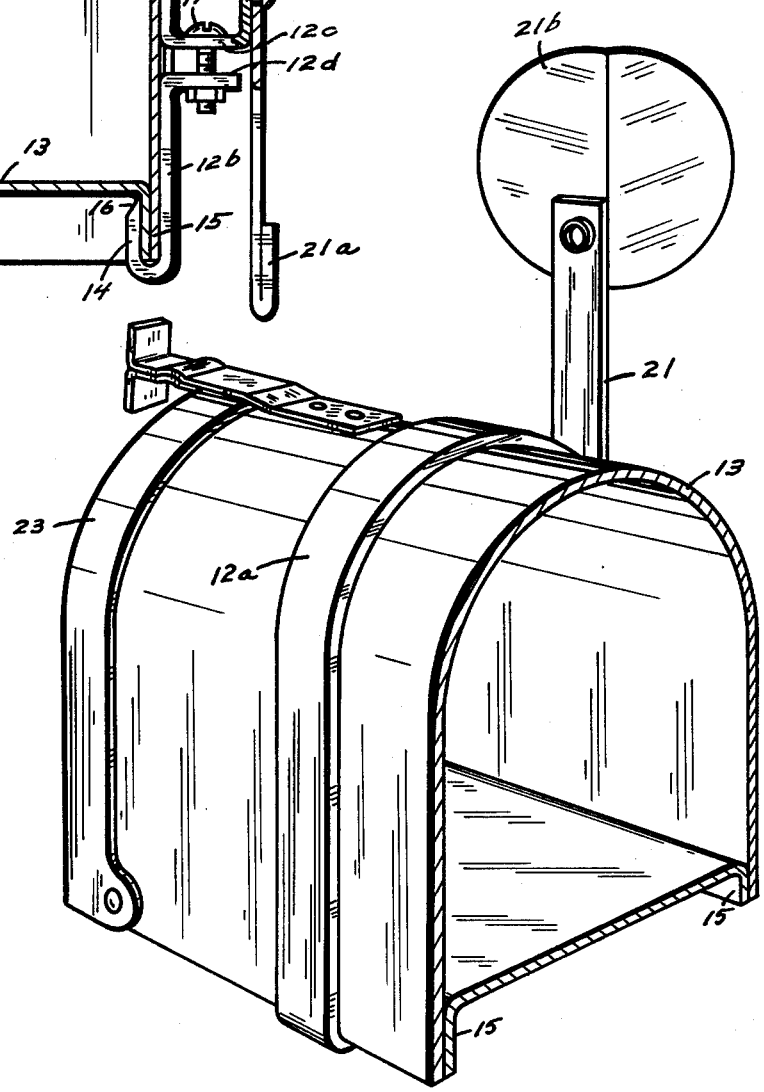
FIG. 7 is a partial left perspective view of the self-contained mailbox signal device assembly clampably attached to a mailbox.

As shown generally in the drawings and more specifically in FIG. 6, the flexible band support member 12 is comprised of two portions, **12*a* and 12*b*. Each of the portions 12*a* and 12*b* are provided with hooked portions 14 at one of the ends thereof which are configured to clampably engage the lower longitudinal side flanges 15 extending downwardly along the sides of the mailbox 13. These flanges 15 are a part of the standard configuration of most rural mailboxes. It should be noted that the hooked portions 14 are provided with sharp beveled edge portions 16 to provide more positive anchoring against the bottom of the mailbox 13. The opposite ends of the band portions, 12*a* and 12*b*, are configured to provide parallel spaced-apart flange portions 12*c* and 12*d* having aligned holes therethrough. Tightening means comprising a nut and bolt assembly 17 is provided through the holes so as to tighten the band portions 12***a* and 12*b* into tight clamping engagement against the outer surface of the mailbox 13 by drawing the hooked portions 14 into engagement with the flanges 15. A vertically-oriented signal arm support flange 18 is provided at one end of the band portion 12*a*. A threaded hole 19 is provided through the support flange 18 so as to threadably engage a shoulder bolt 20. The shoulder bolt 20 is configured to engage and pivotally support the signal arm 21. The pivotal signal arm 21 is provided with a weighted end portion 21*a* at one end thereof and a flag indicator portion 21*b* at the other end thereof. While the shoulder bolt 20 is designed to pass through an opening provided in the signal arm so as to pivotally support the signal arm 21 on the support flange 18, any well-known sleeve and bolt arrangement can be utilized to support the signal arm 21 in its freely pivotal operative use position as shown in the drawings.

Figure 5:
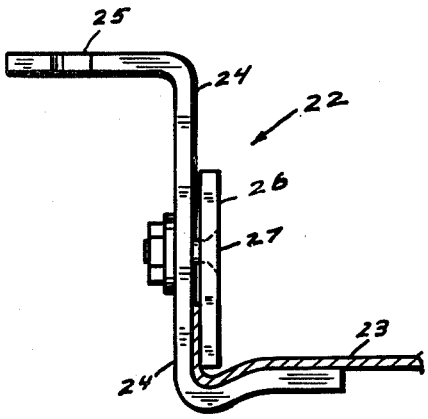
FIG. 5 is a partial sectional view taken on line 5—5 of FIG. 4 showing the support arm extension assembly clampably attached to the mailbox door.
Figure 3:
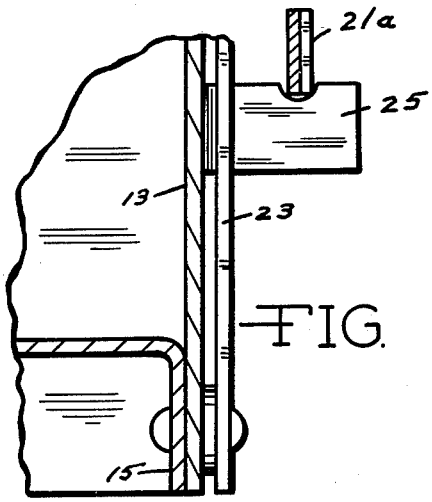
FIG. 3 is a partial sectional view of the invention taken on line 3—3 of FIG. 1 showing the weighted end portion of the pivotal signal arm supported by the support arm extension provided on the mailbox door.

As shown generally in the drawings and more specifically in FIG. 5 a support arm extension assembly 22 is provided for clampable engagement with the standard flange provided on the mailbox door 23. A back-up support plate 26 by use of a bolt 27 cooperates with the support arm extension 24 to clampably engage the flange on the mailbox door 23. The support arm extension 24 is provided with a notched support portion 25 which is configured to extend outwardly from the side of the mailbox 13 so as to supportably engage the weighted portion 21*a* of the signal arm 21, as shown in the drawings and more specifically in FIG. 3.

Figure 2:
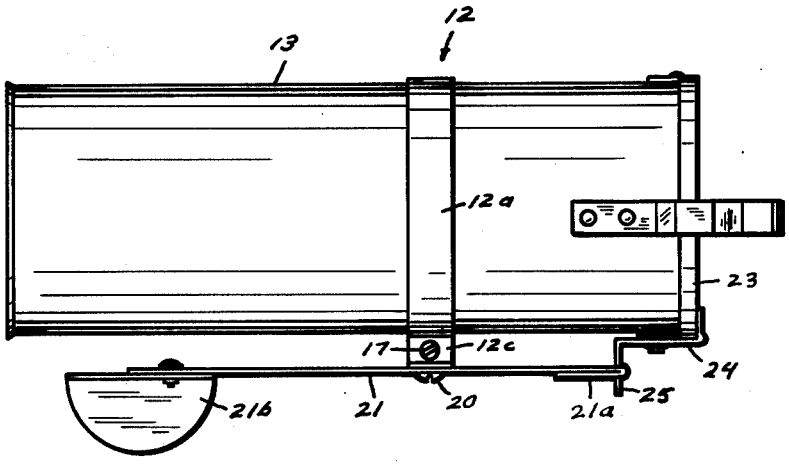
FIG. 2 is a top view of the self-contained mailbox signal device assembly clamp-mounted upon a mailbox and showing the pivotal signal arm in its stored "non-signal" position with the weighted end portion thereof supported by the support arm extension provided on the mailbox door.
Figure 4:
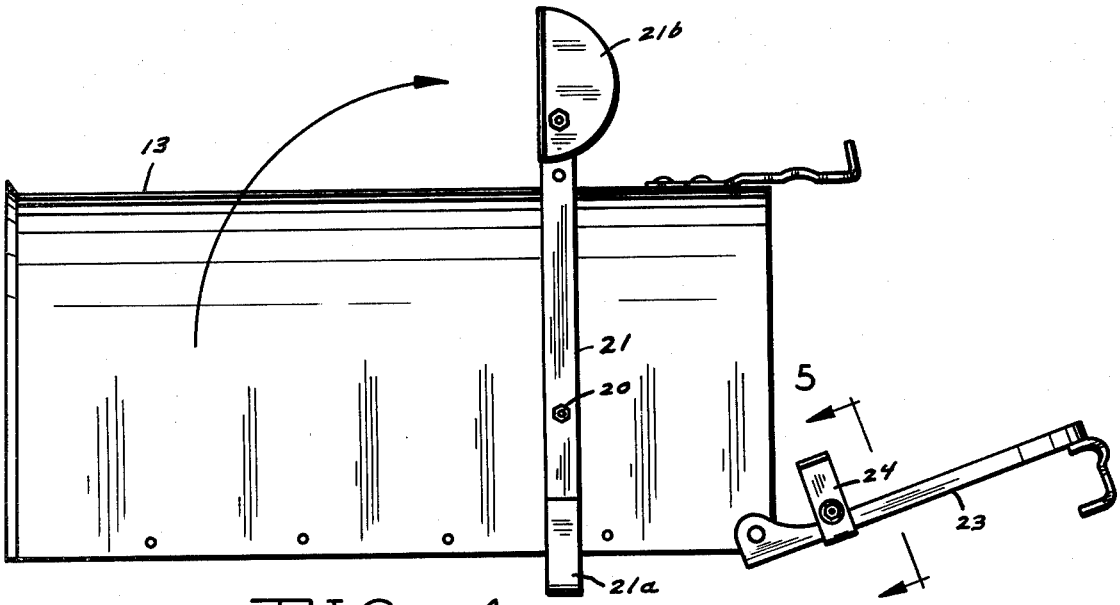
FIG. 4 is a side elevational view of the self-contained mailbox signal device assembly showing the mailbox door in its open position and indicating the pivotal movement of the signal arm to its upright "signal" position.

In operation, the signal arm 21 is placed in its substantially horizontal "non-signal" position with the weighted portion 21*a* thereof resting upon the notched support portion 25 of the support arm extension 24 provided on the closed mailbox door 23, as shown in FIG. 2 and in phantom-line in FIG. 1. As shown in FIG. 4, when the door 23 is opened, the support portion 25 is pulled away from the weighted portion 21*a*, allowing the weighted portion 21*a* to drop in response to gravitational pull. This causes the pivotal signal arm 21 to rotate or pivot to its upright "signal" position with flag indicator portion 21*b* clearly visible to a remote observer, thus indicating that mail has been placed in the mailbox. After the mail has been removed from the mailbox 13, the signal arm is rotated to its horizontal "no-signal" position and the mailbox door 23 is closed so that the weighted portion 21*a* of the signal arm 21 rests on the support portion 25. In this position, the signal device is ready to again signal the arrival of mail to a remote observer.

It is thus seen that a highly utilitarian mailbox signal device assembly is provided which is entirely self-contained and the components of which can be clampably attached to a mailbox structure without violating the structural integrity thereof. There is no need to drill even a single hole in the existing mailbox or otherwise make any structural modification thereto. Further, a highly simplified mailbox signal device is provided which requires no complicated linkage mechanism in operation.

Various other modifications of the invention may be made without departing from the principle thereof. Each of the modifications is to be considered as included in the hereinafter appended claims, unless these claims by their language expressly provide otherwise.

I claim:

1. A self-contained clamp-mounted mailbox signal device assembly comprising:

a first flexible band support member having a mailbox-engaging hooked portion at one end thereof and vertically-oriented signal arm support flange at the opposite end thereof, said first flexible band support member configured to provide a first horizontal adjustment flange proximate to said vertically-oriented signal arm support flange;

a second flexible band support member having a mailbox-engaging hooked portion at one end thereof and a second horizontal adjustment flange at the opposite end thereof, said second horizontal adjustment flange parallel to and spaced apart from said first horizontal adjustment flange;

connector tightening means in association with said first and second horizontal adjustment flanges so as to tighten said first and second flexible band support members into clamping engagement against the outer surface of a mailbox;

a signal arm pivotally mounted on said vertically-oriented signal arm support flange so as to pivot within a vertical plane along one side of a mailbox upon which said band support members are mounted, said pivotal signal arm having a weighted portion at one end thereof and having a flag indicator signal portion at the other end thereof; and an angular support arm extension with a bolted clamping plate clampingly securing said arm on the door flange of the mailbox proximate to said band support members, said support arm extension extending outwardly so as to supportably engage said weighted portion of said signal arm so as to maintain said signal arm in a substantially horizontal position when the mailbox door is closed, said support arm extension disengaging from said weighted portion when the mailbox door is opened so as to permit said signal arm to automatically pivot to an upright vertical signal position.

2. In the signal device assembly of claim 1 wherein each of said adjustable flexible band support members is provided with hooked portions at each end thereof, said hooked portions adapted to retainably engage the lower longitudinal side flange edges of a mailbox.

3. In the signal device assembly of claim 2 wherein said adjustable flexible band support members are provided with tightening connector means in association therewith so as to draw said hooked portions into retentive engagement against said lower side flange edges of said mailbox.

* * * * *